US008952277B2

(12) United States Patent
Liao et al.

(10) Patent No.: US 8,952,277 B2
(45) Date of Patent: Feb. 10, 2015

(54) POWER-SWITCHING DEVICE WITH INTERLOCK MECHANISM

(71) Applicant: Cyber Power Systems Inc., Taipei (TW)

(72) Inventors: Chun-Chao Liao, Taipei (TW); Wen-Ju Hsieh, Taipei (TW); Jian-Jhong Wu, Taipei (TW); Chao-Ching Yang, Taipei (TW)

(73) Assignee: Cyber Power Systems Inc., Taipei (TW)

( * ) Notice: Subject to any disclaimer, the term of this patent is extended or adjusted under 35 U.S.C. 154(b) by 167 days.

(21) Appl. No.: 13/782,972

(22) Filed: Mar. 1, 2013

(65) Prior Publication Data

US 2014/0246293 A1 Sep. 4, 2014

(51) Int. Cl.
*H01H 9/20* (2006.01)
*H01H 9/22* (2006.01)

(52) U.S. Cl.
CPC ..... *H01H 9/22* (2013.01)
USPC ..... 200/50.02

(58) Field of Classification Search
USPC ..... 200/50.02, 50.11, 50.37, 43.16, 17 B
See application file for complete search history.

(56) References Cited

U.S. PATENT DOCUMENTS

| | | | | |
|---|---|---|---|---|
| 6,596,952 | B1 * | 7/2003 | Degrazia et al. | 200/330 |
| 6,805,499 | B2 * | 10/2004 | Westerweck et al. | 396/448 |
| 7,834,280 | B2 * | 11/2010 | Poyner | 200/19.06 |
| 8,253,053 | B2 * | 8/2012 | Yang et al. | 200/547 |
| 2003/0094354 | A1 * | 5/2003 | Badarneh | 200/18 |
| 2004/0233159 | A1 * | 11/2004 | Badarneh | 345/156 |

* cited by examiner

*Primary Examiner* — Vanessa Girardi
(74) *Attorney, Agent, or Firm* — Shimokaji & Associates P.C.

(57) ABSTRACT

A power-switching device with interlock mechanism has a housing with a rotary knob, a slider slidably moved into a rotation range of the rotary knob, and an activation switch mounted on a sliding path of the slider. The activation switch has a control button located on an overlapped portion of the sliding path of the slider and the rotation range of the rotary knob. When the slider approaches the rotary knob, the activation switch is activated and the rotary knob is unable to rotate for being blocked. When the slider departs from the rotary knob, the activation switch is deactivated and the rotary switch is rotatable. Accordingly, when manually bypassing a UPS by turning the rotary knob, users will not forget to deactivate the activation switch, thereby avoiding damaging the UPS.

5 Claims, 10 Drawing Sheets

POWER-SWITCHING DEVICE WITH INTERLOCK MECHANISM

BACKGROUND OF THE INVENTION

1. Field of the Invention

The present invention relates to a power-switching device and more particularly to a power-switching device with interlock mechanism for an uninterruptible power supply (UPS).

2. Description of the Related Art

To ensure more stable AC power to electric equipment without incurring abnormal operation of the electric equipment as a result of irregular power conditions, such as power failure, power interrupt, under-voltage, surge current and the like, most critical electric appliances are connected to AC power sources through UPSs to constantly supply to the electric appliances for maintaining normal operation of the electric appliances.

As most critical electric appliances must be up and running for a long time or even operated till the end of life cycle as a result of natural wear and damage (for example, military radars), if any foregoing UPS is faulty and needs to be repaired, the AC power source must be directly switched to connect to the electric equipment by a manual bypass means to sustain the operation of the electric appliance. Hence, the UPS to be repaired can then be removed for repairing. The manual bypass means is normally performed through a knob being mechanically actuated to disconnect the AC power source and the UPS and connect the AC power source to the electric equipment instead.

However, if the AC power source is directly switched to connect to the electric equipment by the manual bypass means, the UPS to be repaired may immediately supply power through its output circuit to the electric equipment connected to the AC power source using its backup AC power stored in its energy storage circuit just because the input circuit of the UPS does not detect the AC power source. The outcome may be a reverse current of the AC power source, possibly burning out the input circuit of the UPS.

To tackle that problem, many UPSs have a built-in bypass mode capable of being activated through a trigger switch. When the bypass mode is activated, the UPSs will not output their stored backup AC power when detecting no AC power input and the damage to the input circuits of the UPSs can be avoided accordingly.

Nevertheless, less experienced service personnel may forget to activate the bypass mode through the trigger switch before manually bypassing the UPS and the above-mentioned damage to the UPS still inevitably happens.

SUMMARY OF THE INVENTION

An objective of the present invention is to provide a power-switching device with interlock mechanism to prevent a UPS from being damaged due to the separate operation of the activation switch and the rotary knob in a conventional UPS.

To achieve the foregoing objective, the power-switching device with interlock mechanism has a housing, a slider and an activation switch.

The housing has a rotary knob and at least one sliding track. The rotary knob is mounted on the housing and has a rotation range. One end of each one of the at least one sliding track is positioned within the rotation range of the rotary knob.

The slider is slidably mounted on the at least one sliding track, has a sliding path partially overlapping the rotation range, and blocks the rotary knob and prevents the rotary knob from rotating when entering the rotation range of the rotary knob through the sliding path.

The activation switch is mounted on the housing, has a control button overlapping an overlapped portion of the sliding path of the slider and the rotation range of the rotary knob, and is activated when the slider is slidably moved to the overlapped portion of the sliding path of the slider and the control button.

From the foregoing, when approaching the rotary knob, the slider prevents the rotary knob from being rotated to activate a bypass mode of the UPS and allows the UPS to normally operate as the activation switch is activated when the control button of the activation switch contacts the slider. When departing from the rotary knob, the slider allows the rotary knob to be rotatable and lets the UPS enter the bypass mode as the activation switch is deactivated when the control button of the activation switch does not contact the slider. Before the rotary switch can be rotatable, the slider should be slidably moved to depart from the rotary knob and the activation switch is deactivated at the same time. Accordingly, service personnel will not forget to deactivate the activation switch and activate the bypass mode at the same time before manually activating the bypass mode, thereby effectively resolving the damage to a conventional UPS because of the separate operation of the activation switch and the rotary knob.

Other objectives, advantages and novel features of the invention will become more apparent from the following detailed description when taken in conjunction with the accompanying drawings.

DETAILED DESCRIPTION OF THE INVENTION

Figure 1:
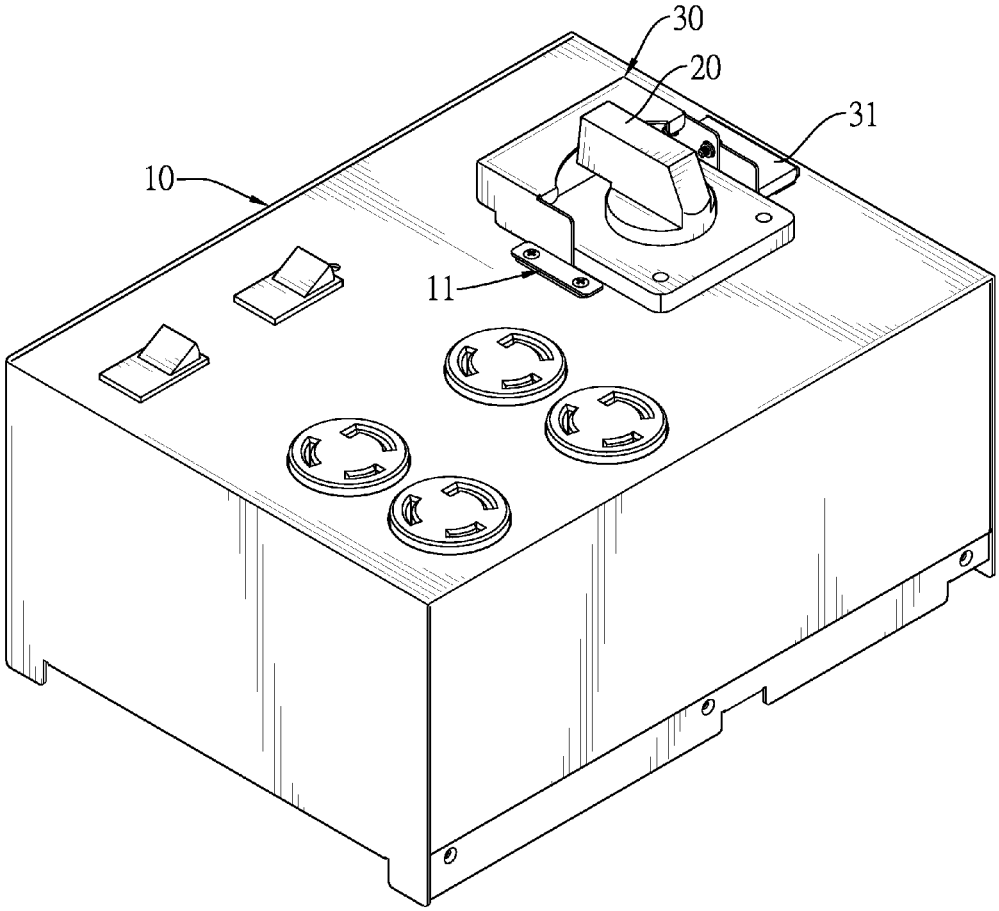
FIG. 1 is perspective view of a power-switching device with interlock mechanism in accordance with the present invention.
Figure 2A:
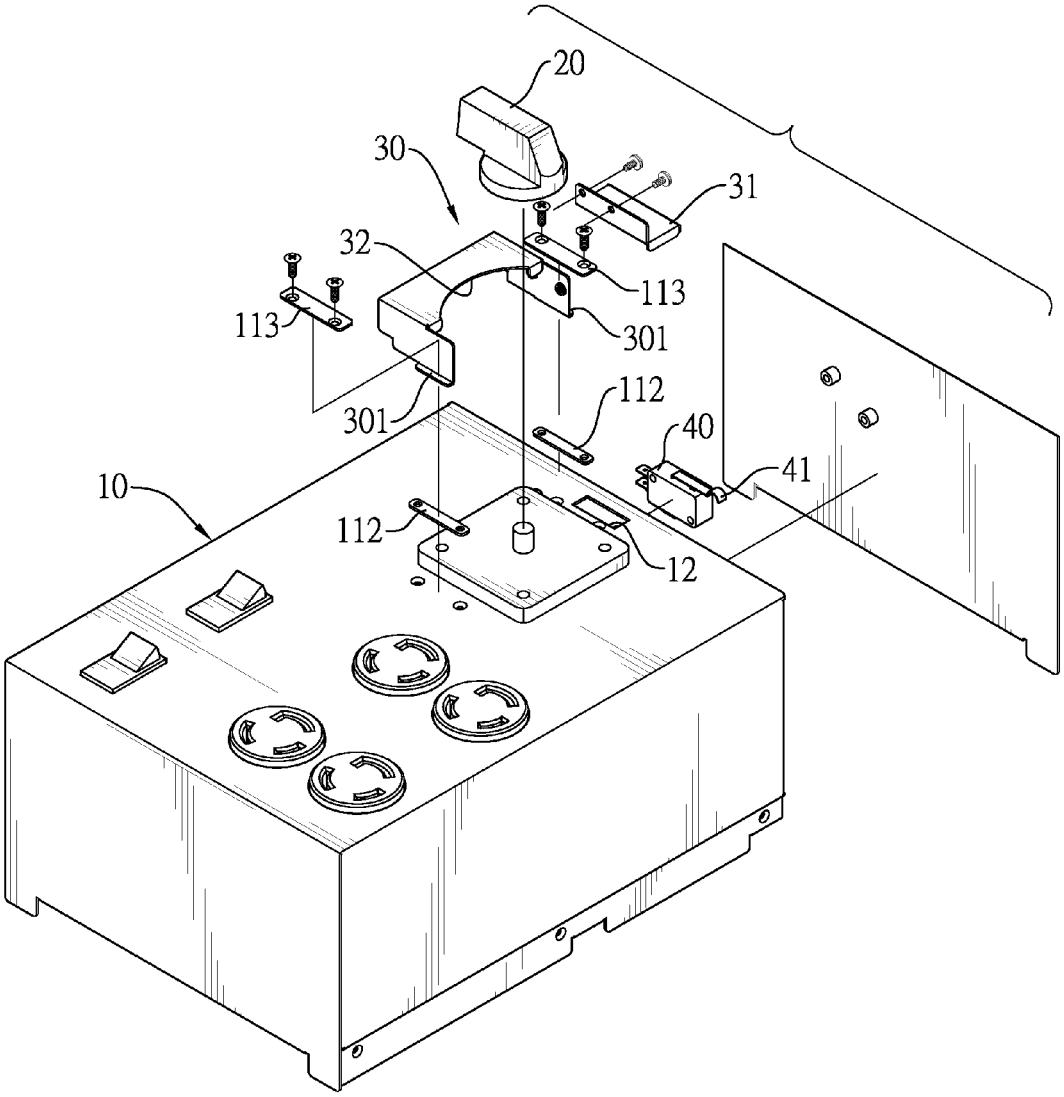
FIG. 2A is a perspective bird's eye exploded view of the power-switching device with interlock mechanism in FIG. 1.
Figure 2B:
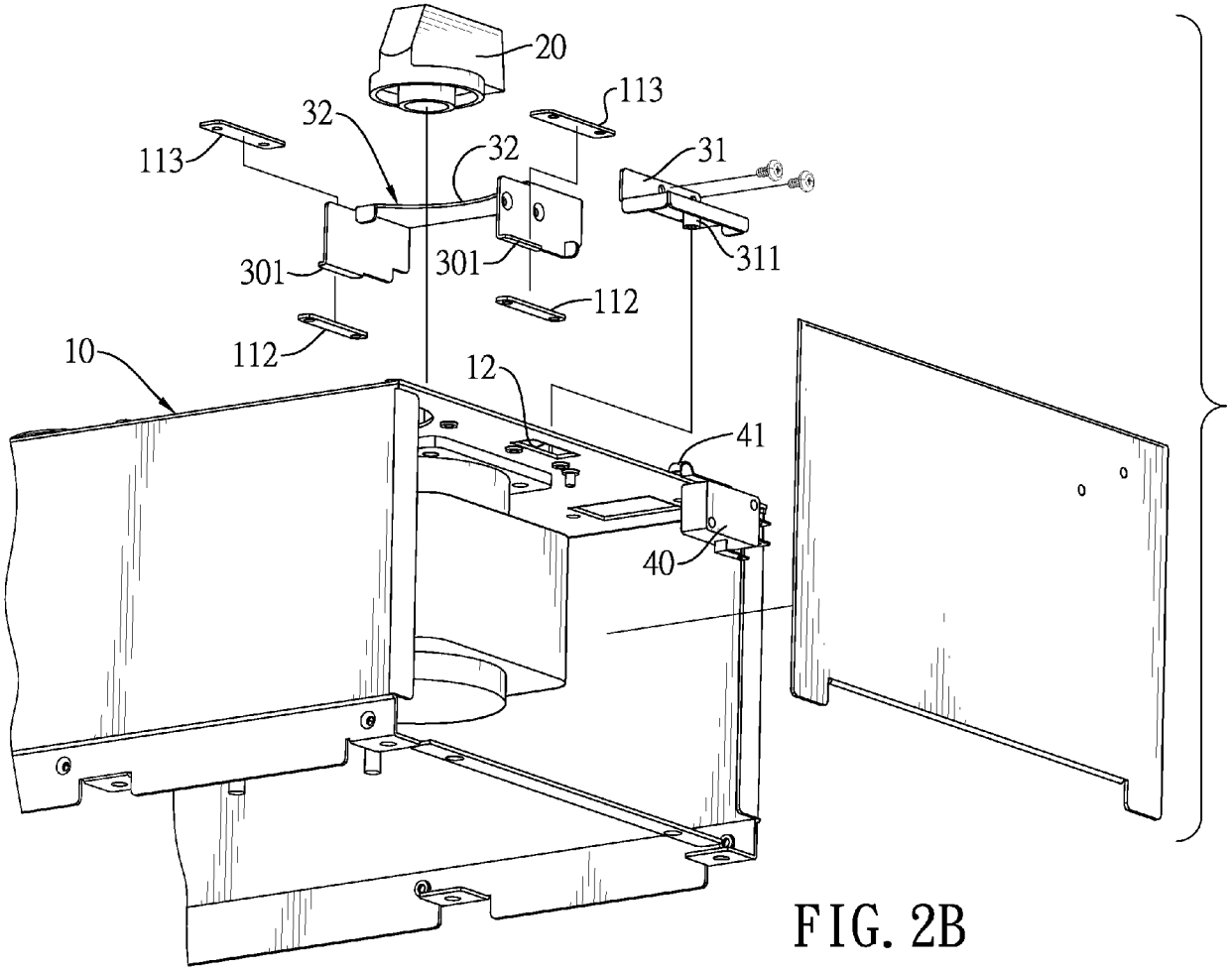
FIG. 2B is a partial perspective worm's eye exploded view of the power-switching device with interlock mechanism in FIG. 1.
Figure 3A:
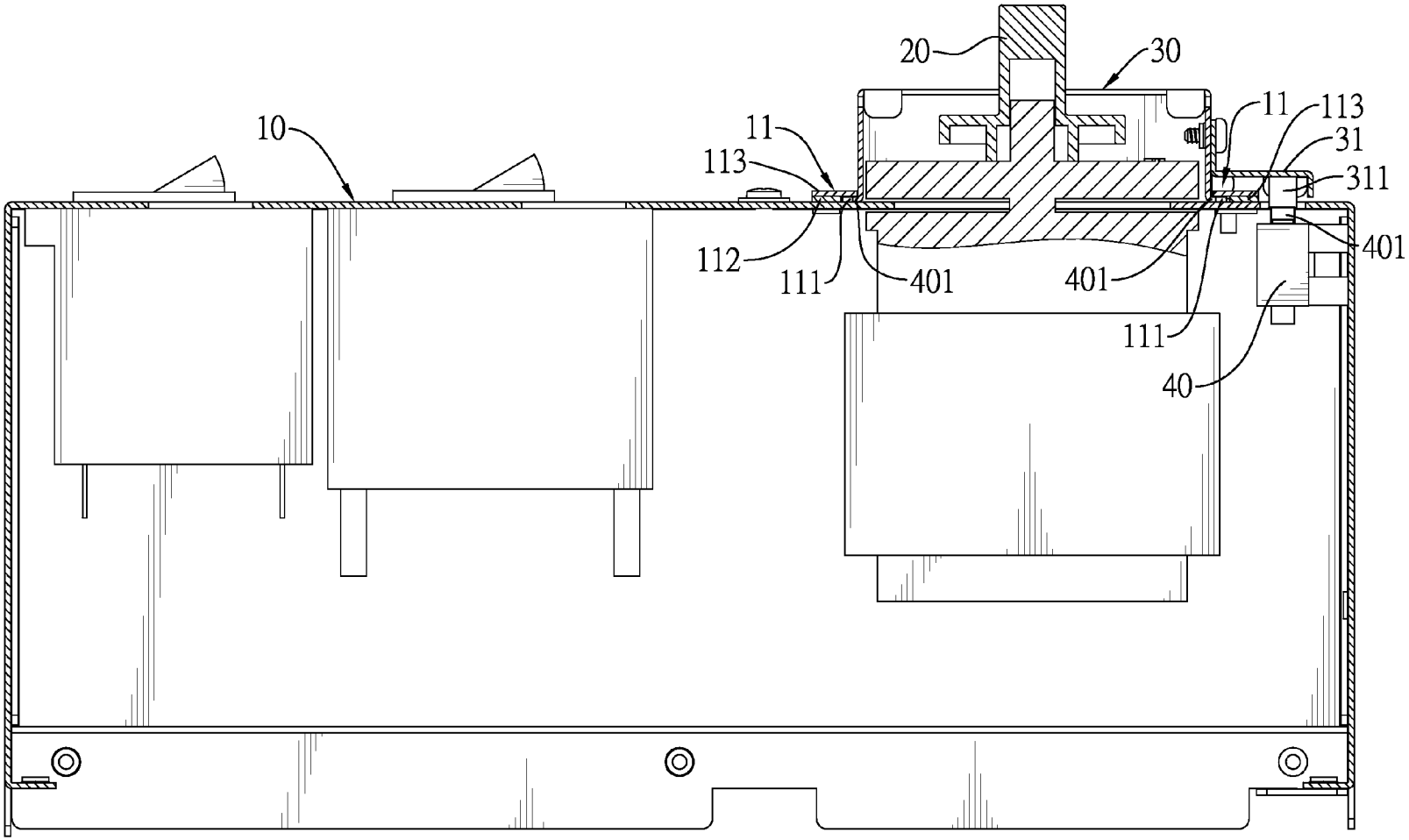
FIG. 3A is an enlarged cross-sectional side view of the power-switching device with interlock mechanism in FIG. 1.
Figure 3B:
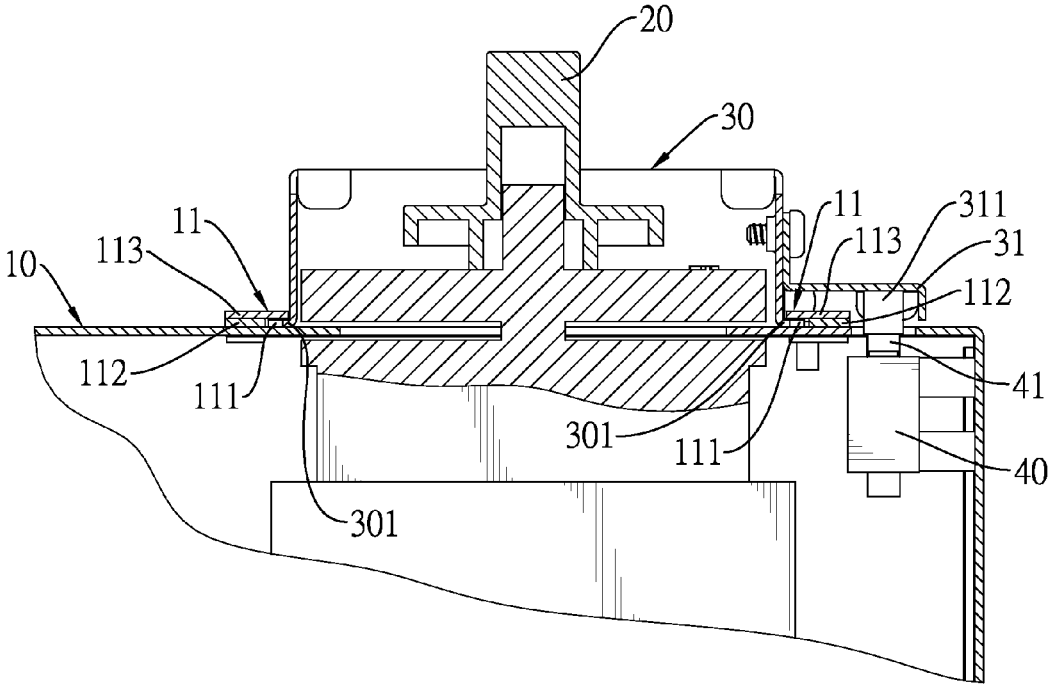
FIG. 3B is an enlarged side view in partial section of the power-switching device with interlock mechanism in FIG. 1.

With reference to FIGS. 1 to 3B, a power-switching device with interlock mechanism in accordance with the present invention has a housing 10, a slider 30 and an activation switch 40.

The housing 10 has a rotary knob 20, at least one sliding track 11 and an opening 12. The rotary knob 20 is mounted on the housing 10 and has a rotation range. The at least one sliding track 11 is mounted on the housing 10 and one end of each one of the at least one sliding track 11 is positioned within the rotation range. In the present embodiment, the rotary knob 20 is mounted on a top of the housing 10. Two parallel sliding tracks 11 are respectively mounted beside two opposite sides of the rotary knob 20 and each sliding track 11 has a sliding slot 111, a first plate 112 and a second plate 113. The sliding slot 111 is formed therein with its opening facing the rotary knob 20. The two first plates 112 are parallelly mounted on the top of the housing 10 and beside the respective sides of the rotary knob 20. Each second plate 113 is stack-mounted on a top of each one of the first plates 112 and protrudes toward the rotary knob 20 to extend beyond the corresponding first plate 112 to constitute a corresponding sliding slot 111 with its opening facing the rotary knob 20. The opening 12 is formed through the top of the housing 10 and is parallel to the sliding tracks 11.

The slider 30 is slidably mounted on the sliding tracks 11 and has a sliding path. The sliding path partially overlaps the rotation range of the rotary knob 20. When entering the rotation range of the rotary knob 20 through the sliding path, the slider 30 blocks the rotary knob 20 and prevents the rotary knob 20 from rotating. In the present embodiment, the slider 30 has two sliding bars 301. Each sliding bar 301 is formed on and protrudes from a bottom edge of one side of the slider 30 adjacent to a corresponding sliding track 11 and toward the opening of one of the sliding slots 111, and is slidably movable within the corresponding sliding slot 111. The slider 30 further has a guiding frame 31 mounted on one of the two sides of the slider 30, positioned above the opening 12 of the housing 10 and having an abutting block 311 formed on a bottom of the guiding frame 31. The abutting block 311 penetrates through the opening 12 into the housing 10. The slider 30 has an arc-shaped notch 32 formed on one side of the slider 30 facing the rotary knob 20.

The activation switch 40 is mounted on the housing 10 and has a control button 41. In the present embodiment, the activation switch 40 is mounted inside the housing 10. The control button 41 is mounted on the activation switch 40 with its top side facing the opening 12 and abutting against the abutting block 311 of the guiding frame 31, and overlaps the overlapped portion of the sliding path of the slider 30 and the rotation range of the rotary knob 20.

Figure 4A:
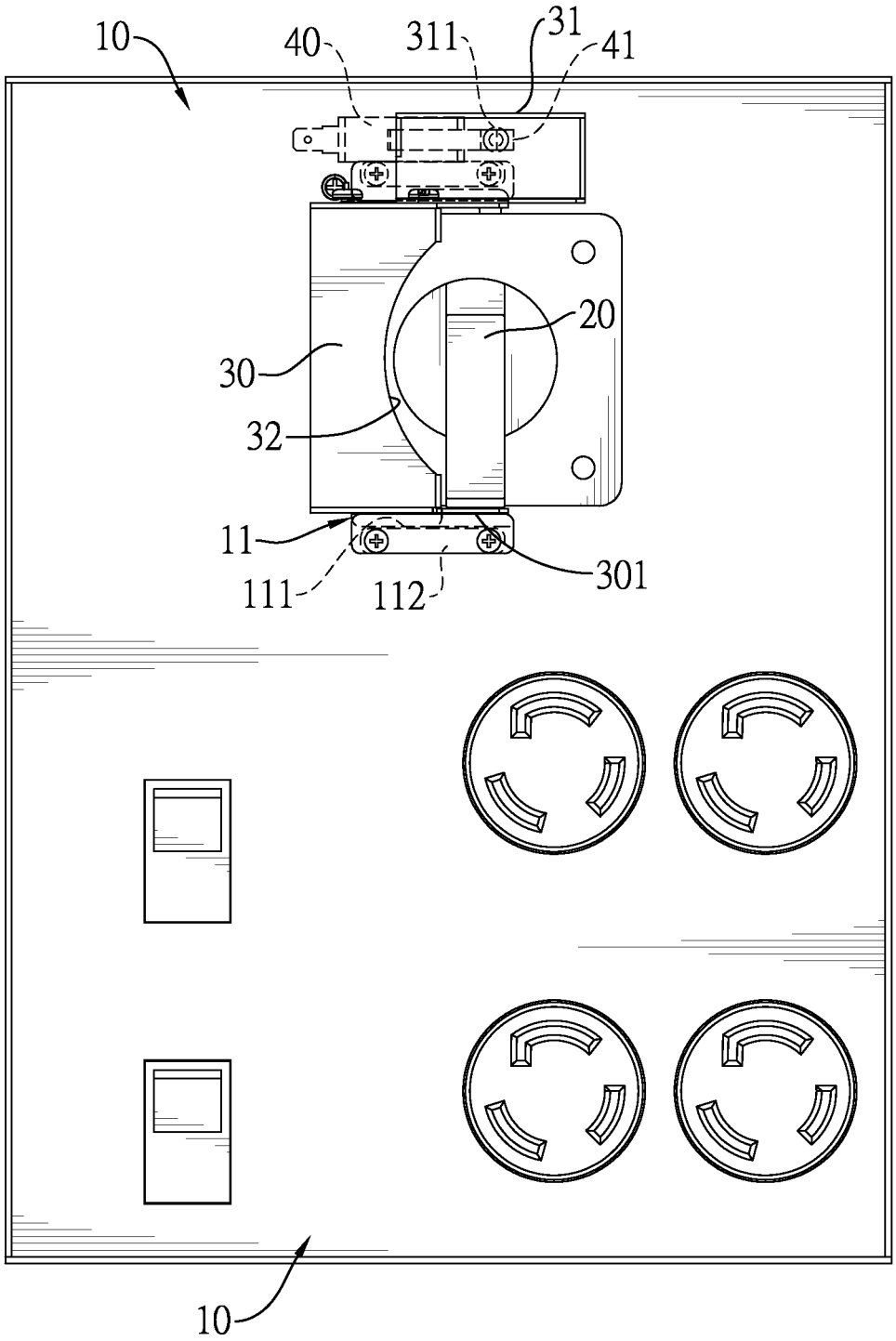
FIG. 4A is an operational top view of the power-switching device with interlock mechanism in FIG. 1 before a slider is moved away from a rotary knob of the device.
Figure 5A:
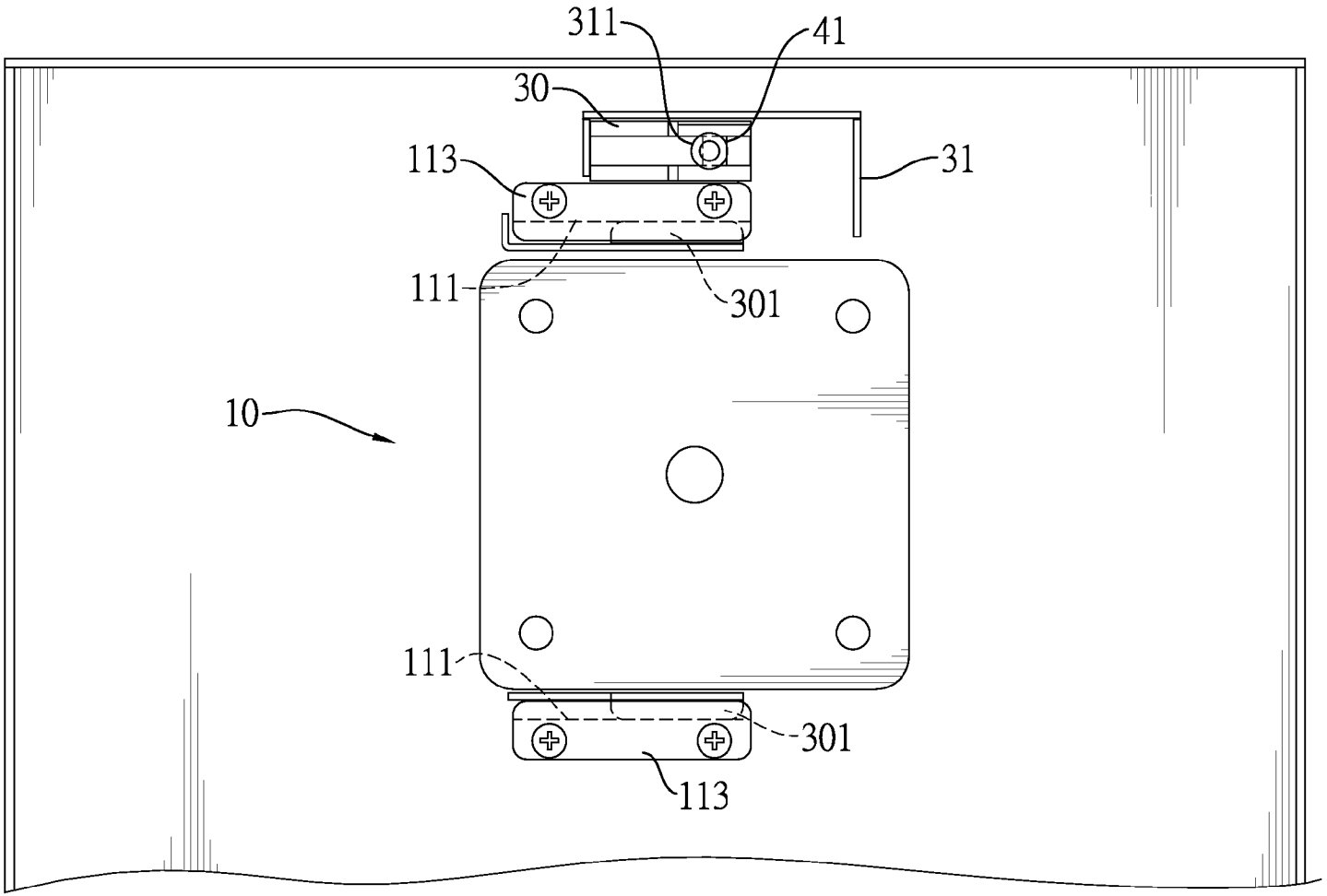
FIG. 5A is an enlarged operational top view in partial section of the power-switching device with interlock mechanism in FIG. 4A.
Figure 6A:
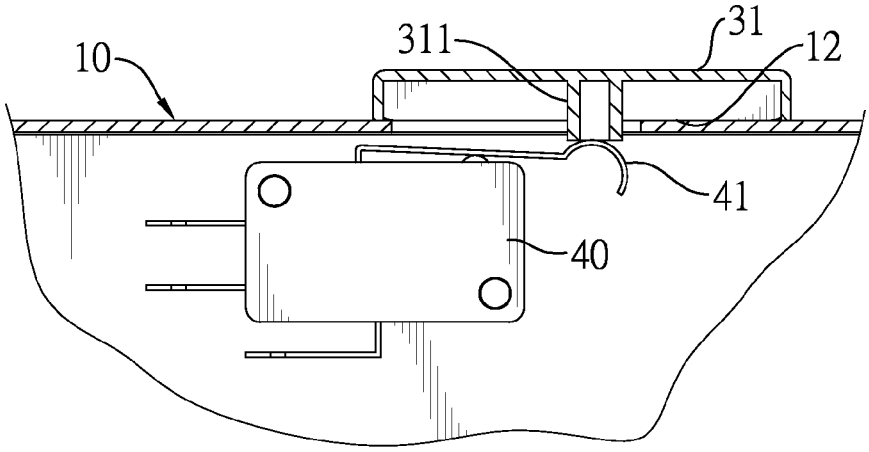
FIG. 6A is an enlarged operational side view in partial section of the power-switching device with interlock mechanism in FIG. 4A.

With reference to FIGS. 4A, 5A and 6A, when the power-switching device with interlock mechanism is mounted inside an existing UPS, the sliding bars 301 of the slider 30 are slidably movable within the respective sliding slots 111 of the sliding tracks 11 so that the slider 30 can approach or depart from the rotary knob 20.

When approaching the rotary knob 20, the slider 30 enters the rotation range of the rotary knob 20 so that the rotary knob 20 is blocked by the slider 30 and fails to be smoothly rotated to switch the power. Meanwhile, the abutting block 311 under the guiding frame 31 contacts the control button 41 of the activation switch 40 to activate the activation switch 40 for the UPS to normally operate.

Figure 4B:
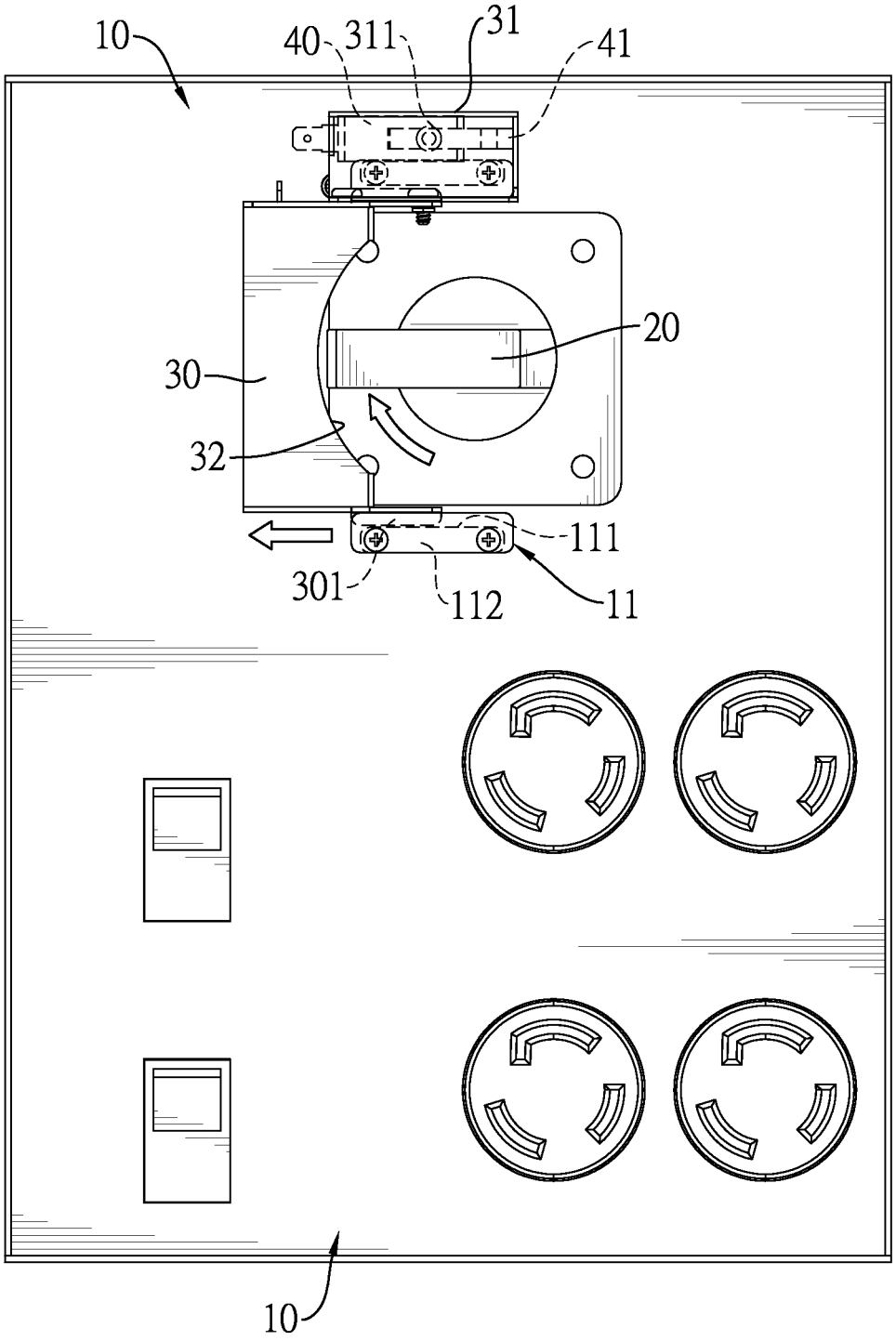
FIG. 4B is an operational top view of the power-switching device with interlock mechanism in FIG. 1 after a slider is moved away from a rotary knob of the device.
Figure 5B:
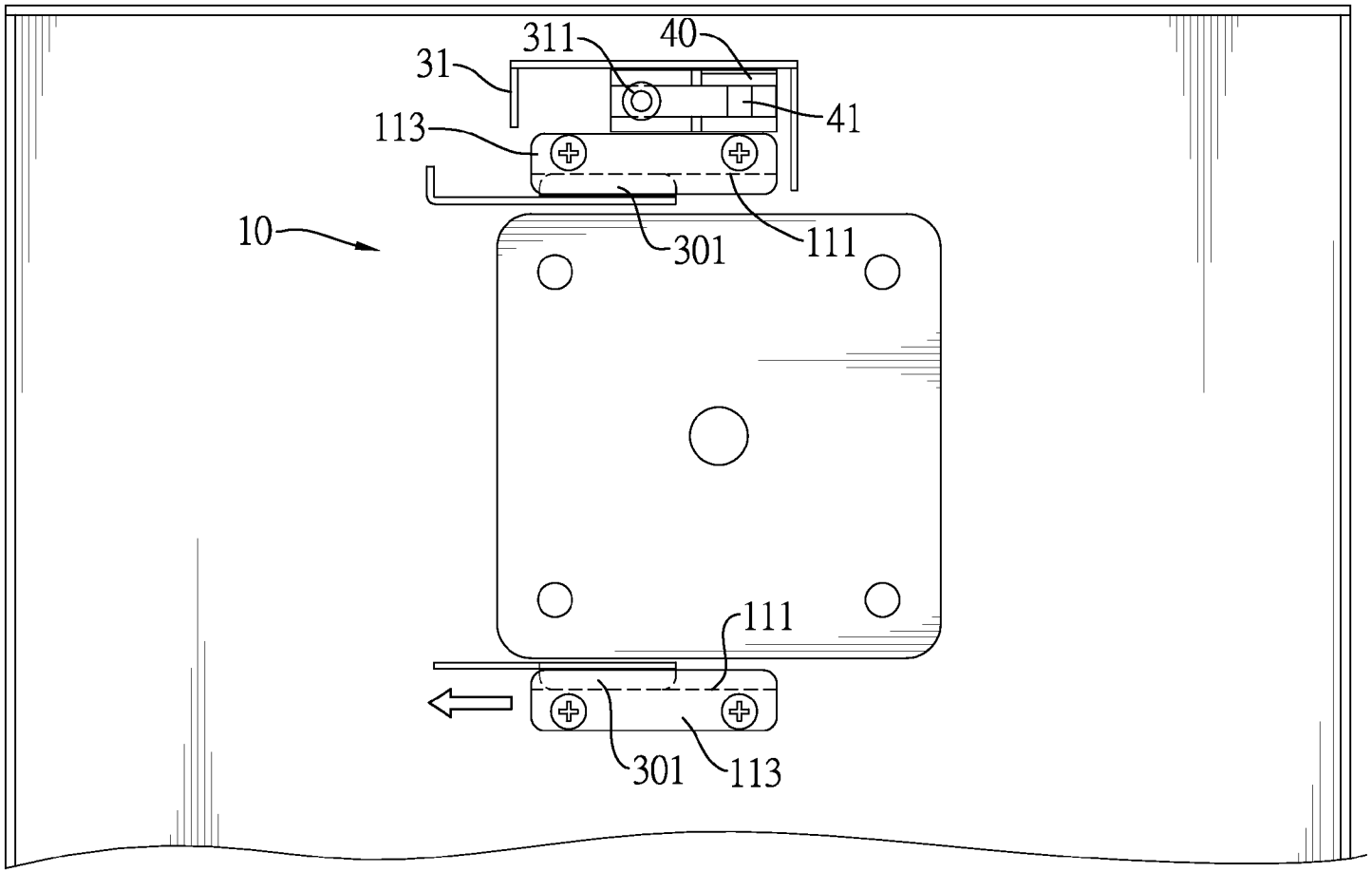
FIG. 5B is an enlarged operational top view in partial section of the power-switching device with interlock mechanism in FIG. 4B.
Figure 6B:
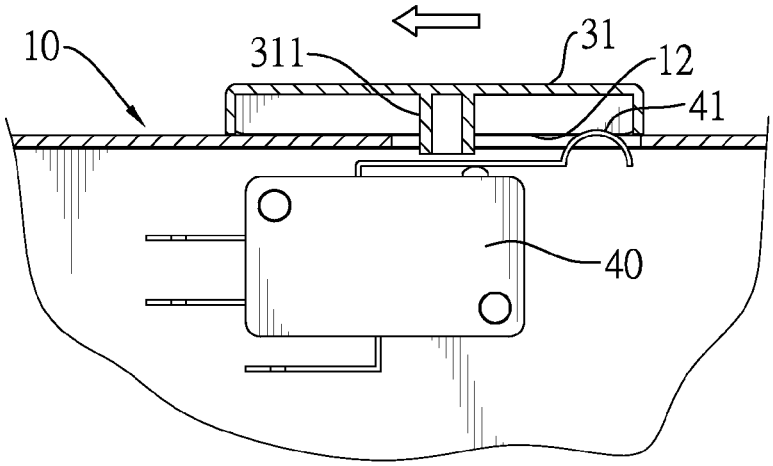
FIG. 6B is an enlarged operational side view in partial section of the power-switching device with interlock mechanism in FIG. 4B.

With reference to FIGS. 4B, 5B and 6B, when the slider 30 departs from the rotary knob 20, the activation switch 40 is immediately deactivated as the control button 41 of the activation switch 40 no longer contacts the abutting block 311 under the guiding frame 31, and the UPS enters the bypass mode. Meanwhile, the rotary knob 20 is not blocked by the slider 30 and can be smoothly rotated to switch the power.

Moreover, the arc-shaped notch 32 of the slider 30 serves to provide a work space for the rotary knob to rotate.

In sum, given the structure of the power-switching device with interlock mechanism, the activation switch is deactivated before the rotary knob 20 is rotated to switch the power, and the UPS having the power-switching device with interlock mechanism enters the bypass mode. When intending to manually bypass the UPS by turning the rotary knob 20, service personnel can never forget to let the UPS enter the bypass mode, thereby effectively avoiding the damage to the UPS because of inappropriate operation of less experienced service personnel.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A power-switching device with interlock mechanism comprising:

a housing having:

a rotary knob mounted on the housing and having a rotation range; and at least one sliding track, wherein one end of each one of the at least one sliding track is positioned within the rotation range of the rotary knob;

a slider slidably mounted on the at least one sliding track, having a sliding path partially overlapping the rotation range, and blocking the rotary knob and preventing the rotary knob from rotating when entering the rotation range of the rotary knob through the sliding path; and an activation switch mounted on the housing, having a control button overlapping an overlapped portion of the sliding path of the slider and the rotation range of the rotary knob, and activated when the slider is slidably moved to the overlapped portion of the sliding path of the slider and the control button.

2. The power-switching device with interlock mechanism as claimed in claim 1, wherein the rotary knob is mounted on a top of the housing and has two parallel sliding tracks respectively mounted beside two opposite sides of the rotary knob, wherein each sliding track has a sliding slot formed therein with its opening facing the rotary knob; and the slider has two sliding bars, wherein each sliding bar is formed on and protrudes from a bottom edge of one side of the slider adjacent to a corresponding sliding track and toward the opening of one of the sliding slots, and is slidably movable within the corresponding sliding slot.

3. The power-switching device with interlock mechanism as claimed in claim 2, wherein each sliding track has a sliding slot, a first plate and a second plate, the two first plates are parallelly mounted on the top of the housing and beside the respective sides of the rotary knob, each second plate is stack-mounted on a top of each one of the first plates and protrudes toward the rotary knob to extend beyond the corresponding first plate to constitute a corresponding sliding slot with its opening facing the rotary knob.

4. The power-switching device with interlock mechanism as claimed in claim 3, wherein the housing has an opening formed through the top of the housing and is parallel to the sliding tracks;

the slider further has a guiding frame mounted on one of the two sides of the slider, positioned above the opening of the housing and having an abutting block formed on a bottom of the guiding frame and penetrating through the opening; and the activation switch is mounted inside the housing and has a control button mounted on the activation switch with its top side facing the opening and abutting against the abutting block of the guiding frame.

5. The power-switching device with interlock mechanism as claimed in claim 4, wherein the slider has an arc-shaped notch formed on one side of the slider facing the rotary knob.

* * * * *